US011426853B2

(12) United States Patent
Kawai

(10) Patent No.: US 11,426,853 B2
(45) Date of Patent: Aug. 30, 2022

(54) POWER TOOL HAVING IMPROVED AIR EXHAUST PORTS

(71) Applicant: MAKITA CORPORATION, Anjo (JP)

(72) Inventor: Yasuhito Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 204 days.

(21) Appl. No.: 16/793,434

(22) Filed: Feb. 18, 2020

(65) Prior Publication Data

US 2020/0269407 A1 Aug. 27, 2020

(30) Foreign Application Priority Data

Feb. 21, 2019 (JP) ..... JP2019-029739

(51) Int. Cl.
*B25D 11/06* (2006.01)
*B25D 16/00* (2006.01)
*B25D 17/20* (2006.01)

(52) U.S. Cl.
CPC ..... *B25D 17/20* (2013.01); *B25D 11/06* (2013.01); *B25D 16/00* (2013.01);
(Continued)

(58) Field of Classification Search
CPC ..... B01D 2273/10; B01D 2313/16; B01L 2300/048; B25D 11/06; B25D 2217/0057;
(Continued)

(56) References Cited

U.S. PATENT DOCUMENTS 2,155,082 A * 4/1939 Decker ..... B23B 45/001 408/124
2,456,571 A * 12/1948 Turner ..... B23Q 11/127 310/58

(Continued)

FOREIGN PATENT DOCUMENTS

CN 102825582 A 12/2012
CN 102950585 A 3/2013

(Continued)

OTHER PUBLICATIONS

Office Action and Search Report from the Chinese Patent Office dated May 7, 2022, in counterpart Chinese application No. 201911410161.7, and machine translation thereof.

*Primary Examiner* — Thanh K Truong
*Assistant Examiner* — David G Shutty
(74) *Attorney, Agent, or Firm* — J-Tek Law PLLC; Jeffrey D. Tekanic; Scott T. Wakeman

(57) ABSTRACT

A power tool, such as an impact driver, includes a motor having a rotor that rotates relative to a stator, and a centrifugal fan that rotates together with the rotor. A motor housing and a rear housing house the motor. Overlapping parts of the motor housing and the rear housing radially surround an outer circumference of the centrifugal fan. Air exhaust ports are defined in each of the overlapping parts and are offset in an axial direction of the rotor. Fluid communication paths are defined between the air exhaust ports in the overlapping parts. The fluid communication paths have an opening area or width in the axial direction that is smaller than an opening area or width in the axial direction of the air exhaust ports.

16 Claims, 8 Drawing Sheets

(52) U.S. Cl.
CPC ..... *B25D 2217/0061* (2013.01); *B25D 2217/0065* (2013.01); *B25D 2250/121* (2013.01)

(58) Field of Classification Search
CPC .... B25D 2217/0061; B25D 2217/0065; B25D 2250/121; H04R 1/2846
See application file for complete search history.

(56) References Cited

U.S. PATENT DOCUMENTS

| | | | | |
|---|---|---|---|---|
| 3,114,421 | A | 12/1963 | McCloud | |
| 3,144,571 | A | 8/1964 | Kukulski | |
| 4,202,096 | A | 5/1980 | Nagashima | |
| 4,450,919 | A | 5/1984 | Cousineau | |
| 4,638,562 | A | 1/1987 | Drake | |
| 4,664,394 | A | 5/1987 | Theissig et al. | |
| 4,667,749 | A | 5/1987 | Keller | |
| 4,670,985 | A | 6/1987 | Biersteker | |
| 5,692,574 | A | 12/1997 | Terada | |
| 5,697,456 | A | 12/1997 | Radle et al. | |
| 6,213,224 | B1 | 4/2001 | Furuta et al. | |
| 6,294,857 | B1 * | 9/2001 | Nakane | H01R 39/41 310/239 |
| 6,543,549 | B1 * | 4/2003 | Riedl | B25F 5/02 173/171 |
| 6,776,245 | B2 * | 8/2004 | Kristen | B25D 17/20 173/171 |
| 6,805,625 | B2 * | 10/2004 | Champeau | H05K 5/0213 454/261 |
| 7,051,820 | B2 | 5/2006 | Stirm | |
| 7,134,510 | B2 * | 11/2006 | Justis | B25F 5/02 29/418 |
| 7,143,842 | B2 | 12/2006 | Ikuta | |
| 7,832,499 | B2 * | 11/2010 | Komuro | B25F 5/008 173/171 |
| 8,123,596 | B2 * | 2/2012 | Kobayashi | B25F 5/008 451/344 |
| 8,220,561 | B2 * | 7/2012 | Milbourne | B25B 21/00 475/263 |
| 8,398,465 | B2 * | 3/2013 | Hoeschele | B25F 5/008 451/454 |
| 8,410,645 | B2 * | 4/2013 | Lau | B25F 5/008 173/217 |
| 8,966,773 | B2 | 3/2015 | Gregorich | |
| 9,044,849 | B2 * | 6/2015 | Maute | B24B 23/028 |
| 9,676,092 | B2 * | 6/2017 | Kumagai | B25F 5/02 |
| 9,878,435 | B2 * | 1/2018 | Ito | B25F 5/008 |
| 10,193,422 | B2 * | 1/2019 | Kouda | H02K 1/146 |
| 10,270,316 | B2 * | 4/2019 | Niwa | B25F 5/008 |
| 10,562,107 | B2 * | 2/2020 | Harada | B25F 5/008 |
| 10,608,500 | B2 * | 3/2020 | Nagahama | H02K 9/06 |
| 10,836,027 | B2 * | 11/2020 | Yang | B24B 23/028 |
| 2001/0037889 | A1 | 11/2001 | Kristen et al. | |
| 2002/0125023 | A1 | 9/2002 | Hanke et al. | |
| 2003/0121679 | A1 | 7/2003 | Taga | |
| 2003/0194964 | A1 | 10/2003 | Champeau et al. | |
| 2004/0194987 | A1 | 10/2004 | Hanke et al. | |
| 2004/0211576 | A1 | 10/2004 | Milbourne et al. | |
| 2005/0157489 | A1 | 7/2005 | Oomori et al. | |
| 2005/0257945 | A1 | 11/2005 | Justis et al. | |
| 2005/0269117 | A1 | 12/2005 | Sato et al. | |
| 2006/0231277 | A1 | 10/2006 | Puzio et al. | |
| 2007/0044984 | A1 | 3/2007 | Fischer et al. | |
| 2007/0144310 | A1 | 6/2007 | Pozgay et al. | |
| 2007/0159812 | A1 | 7/2007 | Oomori et al. | |
| 2007/0209814 | A1 | 9/2007 | Furusawa et al. | |
| 2007/0261871 | A1 | 11/2007 | Ohlendorf | |
| 2007/0295522 | A1 | 12/2007 | Bohne et al. | |
| 2009/0049651 | A1 | 2/2009 | Roberts et al. | |
| 2009/0223691 | A1 | 9/2009 | Ikuta et al. | |
| 2009/0236110 | A1 | 9/2009 | Iwakami et al. | |
| 2009/0266571 | A1 | 10/2009 | Baumann et al. | |
| 2009/0314507 | A1 | 12/2009 | Iwakami | |
| 2009/0321101 | A1 | 12/2009 | Furusawa et al. | |
| 2010/0000748 | A1 | 1/2010 | Machida et al. | |
| 2010/0038105 | A1 | 2/2010 | Kikuchi et al. | |
| 2010/0051304 | A1 | 3/2010 | Aoki | |
| 2010/0095533 | A1 | 4/2010 | Takahashi et al. | |
| 2011/0011608 | A1 | 1/2011 | Saur | |
| 2011/0083868 | A1 | 4/2011 | Nishikimi et al. | |
| 2011/0088922 | A1 | 4/2011 | Hirayama et al. | |
| 2011/0100665 | A1 | 5/2011 | Nakashima | |
| 2011/0114347 | A1 | 5/2011 | Kasuya et al. | |
| 2011/0127055 | A1 | 6/2011 | Braun et al. | |
| 2011/0147031 | A1 | 6/2011 | Matthias et al. | |
| 2011/0168422 | A1 | 7/2011 | Fujiwara et al. | |
| 2011/0199756 | A1 | 8/2011 | Oomori et al. | |
| 2011/0203826 | A1 | 8/2011 | Hosokawa et al. | |
| 2011/0290517 | A1 | 12/2011 | Takeuchi et al. | |
| 2011/0297407 | A1 | 12/2011 | Sakai | |
| 2011/0303726 | A1 | 12/2011 | Blessing et al. | |
| 2011/0303733 | A1 | 12/2011 | Fielitz et al. | |
| 2011/0308828 | A1 | 12/2011 | Shinma et al. | |
| 2012/0031638 | A1 | 2/2012 | Kamegai et al. | |
| 2012/0033405 | A1 | 2/2012 | Oomori et al. | |
| 2012/0067605 | A1 | 3/2012 | Furusawa et al. | |
| 2012/0097410 | A1 | 4/2012 | Honsa | |
| 2012/0160533 | A1 | 6/2012 | Kamegai | |
| 2012/0255753 | A1 | 10/2012 | Kuhnle et al. | |
| 2012/0279740 | A1 | 11/2012 | Furusawa et al. | |
| 2012/0315103 | A1 | 12/2012 | Aoki | |
| 2012/0318549 | A1 | 12/2012 | Nagasaka et al. | |
| 2012/0318551 | A1 | 12/2012 | Kuhnle et al. | |
| 2013/0043052 | A1 | 2/2013 | Harcar et al. | |
| 2013/0099722 | A1 | 4/2013 | Umemura et al. | |
| 2013/0153253 | A1 | 6/2013 | Ludy et al. | |
| 2013/0168121 | A1 | 7/2013 | Ullrich et al. | |
| 2013/0199810 | A1 | 8/2013 | Wyler | |
| 2014/0174777 | A1 | 6/2014 | Kakiuchi et al. | |
| 2014/0209338 | A1 | 7/2014 | Harada et al. | |
| 2015/0027743 | A1 | 1/2015 | Kumagai | |
| 2015/0041170 | A1 | 2/2015 | Yoshikane et al. | |
| 2015/0174753 | A1 | 6/2015 | Kamiya | |
| 2015/0280517 | A1 | 10/2015 | Ekstrom et al. | |
| 2015/0328759 | A1 | 11/2015 | Ikuta et al. | |
| 2015/0343617 | A1 | 12/2015 | Kondo et al. | |
| 2015/0372633 | A1 | 12/2015 | Machida et al. | |
| 2016/0001433 | A1 | 1/2016 | Furusawa et al. | |
| 2016/0136801 | A1 | 5/2016 | Furusawa et al. | |
| 2016/0151905 | A1 | 6/2016 | Tada et al. | |
| 2016/0336838 | A1 * | 11/2016 | Kou | H02K 1/146 |
| 2017/0106517 | A1 | 4/2017 | Machida | |
| 2017/0106518 | A1 | 4/2017 | Takeuchi et al. | |
| 2017/0194846 | A1 | 7/2017 | Tanimoto | |
| 2017/0214292 | A1 * | 7/2017 | Nagahama | H02K 1/12 |
| 2017/0312902 | A1 | 11/2017 | Noguchi et al. | |
| 2018/0099393 | A1 | 4/2018 | Iida et al. | |
| 2018/0099396 | A1 | 4/2018 | Iida et al. | |

FOREIGN PATENT DOCUMENTS

| | | | |
|---|---|---|---|
| CN | 105313064 | A | 2/2016 |
| DE | 102006044433 | A1 | 4/2008 |
| EP | 1477282 | A1 | 11/2004 |
| EP | 2468455 | A1 | 6/2012 |
| FR | 2488179 | A1 | 2/1982 |
| GB | 2154497 | A | 9/1985 |
| JP | S55151482 | U | 10/1980 |
| JP | S5976218 | A | 5/1984 |
| JP | S6181888 | U | 5/1986 |
| JP | 2005219195 | A | 8/2005 |
| JP | 2007196337 | A | 8/2007 |
| JP | 2010144921 | A | 7/2010 |
| JP | 2014024126 | A | 2/2014 |
| JP | 2014124697 | A | 7/2014 |
| JP | 2014124698 | A | 7/2014 |
| JP | 2014133284 | A | 7/2014 |
| JP | 2016022567 | A | 2/2016 |
| JP | 2019000936 | A | 1/2019 |
| WO | 2008034668 | A1 | 3/2008 |

(56) References Cited

FOREIGN PATENT DOCUMENTS

| | | | |
|---|---|---|---|
| WO | 2015145583 | A1 | 10/2015 |
| WO | 2015190355 | A1 | 12/2015 |

* cited by examiner

POWER TOOL HAVING IMPROVED AIR EXHAUST PORTS

CROSS-REFERENCE

The present application claims priority to Japanese patent application serial number 2019-029739 filed on Feb. 21, 2019, the contents of which are incorporated fully herein by reference.

TECHNICAL FIELD

The present invention generally relates to a power tool, such as an impact driver, that exhausts air drawn into the interior of the power tool by a fan rotated by a motor.

BACKGROUND ART

For example, Japanese Laid-open Patent Publication 2019-936 discloses an impact driver having a motor provided in a rear part and an output part provided in a front part. The output part includes an anvil that is rotationally impacted (struck) when the motor is driven. A fan for cooling the motor is provided on a rotary shaft of the motor. Vents (air exhaust ports) are formed in a rear part of a housing that houses the motor and the output part and the vents are arranged to exhaust air drawn into the housing by the fan.

SUMMARY OF THE INVENTION

With regard to such vents, it is necessary to take measures to prevent the ingress of foreign matter, such as dust, water, and the like, and thereby to prevent the occurrence of damage to internal mechanisms, electrical shorts, and the like. In particular, because the fan is located on the inner side of the air exhaust ports, it is preferable to utilize one or more protective structures deemed to be IP4X or higher, in accordance with the Ingress Protection (IP) code, IEC standard 60529, which concerns protective structures for devices as defined by standards published by the International Electrotechnical Commission (IEC), so that a pin having a diameter of 1.0 mm is inaccessible into the housing of the power tool.

It is therefore one non-limiting object of the present teachings to disclose a power tool that effectively prevents or at least minimizes the ingress of foreign matter via air exhaust ports.

In one aspect of the present teachings, a power tool such as an impact driver comprises: a motor comprising a stator, a rotor rotatable relative to the stator, and a fan rotatable integrally with the rotor; and a first housing and a second housing, which (i) are made of a polymer material (resin), (ii) house the motor, and (iii) respectively have portions, located on an outer-circumference side of the fan, along which they mutually overlap in a radial direction of the fan. Air exhaust ports for the fan are respectively formed in the mutually overlapping portions of the first housing and the second housing, such that first air exhaust ports in the first housing are offset from second air exhaust ports in the second housing, preferably in the axial direction of the rotor. In addition, communication paths, whose opening area is smaller than the opening areas of the first and second exhaust ports, are provided between the first exhaust ports on the first housing side and the second exhaust ports on the second housing side.

In another aspect of the present teachings, a power tool such as an impact driver comprises: a motor comprising a stator, a rotor rotatable relative to the stator, and a fan rotatable integrally with the rotor; a motor housing, which is made of a polymer material (resin), covers at least a portion of the motor, and extends in the front-rear direction; a grip housing, which extends integrally downward from the motor housing; and a rear housing, which closes up a rear portion of the motor housing. The motor housing and the rear housing have the mutually overlapping portions located on the outer-circumference side and in the radial direction of the fan. Air exhaust ports for the fan are formed in each overlapping portion such that first air exhaust ports in the first housing are offset from second air exhaust ports in the second housing, preferably in the axial direction of the rotor. In addition, communication paths, whose opening area is smaller than the opening areas of the first and second exhaust ports, are provided between the first exhaust ports on the motor-housing side and the second exhaust ports on the rear-housing side.

Optionally, the overlapping portions do not contact each other in the radial direction of the fan, and the communication paths are provided between the overlapping portions.

Optionally, the first and second exhaust ports are slit shaped, extend around a circumferential direction of the fan, and are formed such that, in the overlapping portions, they are offset from each other in an axial direction of the rotor.

In another aspect of the present teachings, a power tool such as an impact driver comprises: a motor comprising a stator, a rotor rotatable relative to the stator, and a fan rotatable integrally with the rotor; and a first housing and a second housing, which (i) are made of a polymer material (resin), (ii) house the motor, and (iii) respectively have portions, located on an outer-circumference side of the fan, along which they mutually overlap in a radial direction of the fan. Air exhaust ports for the fan are respectively formed in the mutually overlapping portions of the first housing and the second housing, such that first air exhaust ports in the first housing are offset from second air exhaust ports in the second housing, preferably in the axial direction of the rotor. In addition, communication paths, whose opening projection area is smaller than the opening areas of the first and second exhaust ports, are provided between the first exhaust ports on the first housing side and the second exhaust ports on the second housing side.

In another aspect of the present teachings, a power tool such as an impact driver comprises: a motor comprising a stator, a rotor rotatable relative to the stator, and a fan rotatable integrally with the rotor; and a first housing and a second housing, which (i) are made of a polymer material (resin), (ii) house the motor, and (iii) respectively have portions, located on an outer-circumference side of the fan, along which they mutually overlap in a radial direction of the fan. Air exhaust ports for the fan are respectively formed in the mutually overlapping portions of the first housing and the second housing, such that the air exhaust ports in the first housing are offset from the air exhaust ports in the second housing, preferably in an axial direction of the rotor.

Thus, the ingress of foreign matter via air exhaust ports can be effectively prevented or at least minimized in one or more embodiments of the present teachings. Additional objects, aspects, embodiments and advantages of the present teachings will become apparent upon reading the following detailed description of embodiments of the present teachings in conjunction with the appended Figures and claims.

BRIEF DESCRIPTION OF THE DRAWINGS

FIGS. 6A-6E provide explanatory diagrams for explaining a rear housing, wherein FIG. 6A is a rear view, FIG. 6B is a side view, FIG. 6C is a front view, FIG. 6D is an oblique view from the front, and FIG. 6E is a cross section taken along line B-B.

DETAILED DESCRIPTION OF EMBODIMENTS

Embodiments of the present teachings are explained below, with reference to the drawings.

Figure 1:
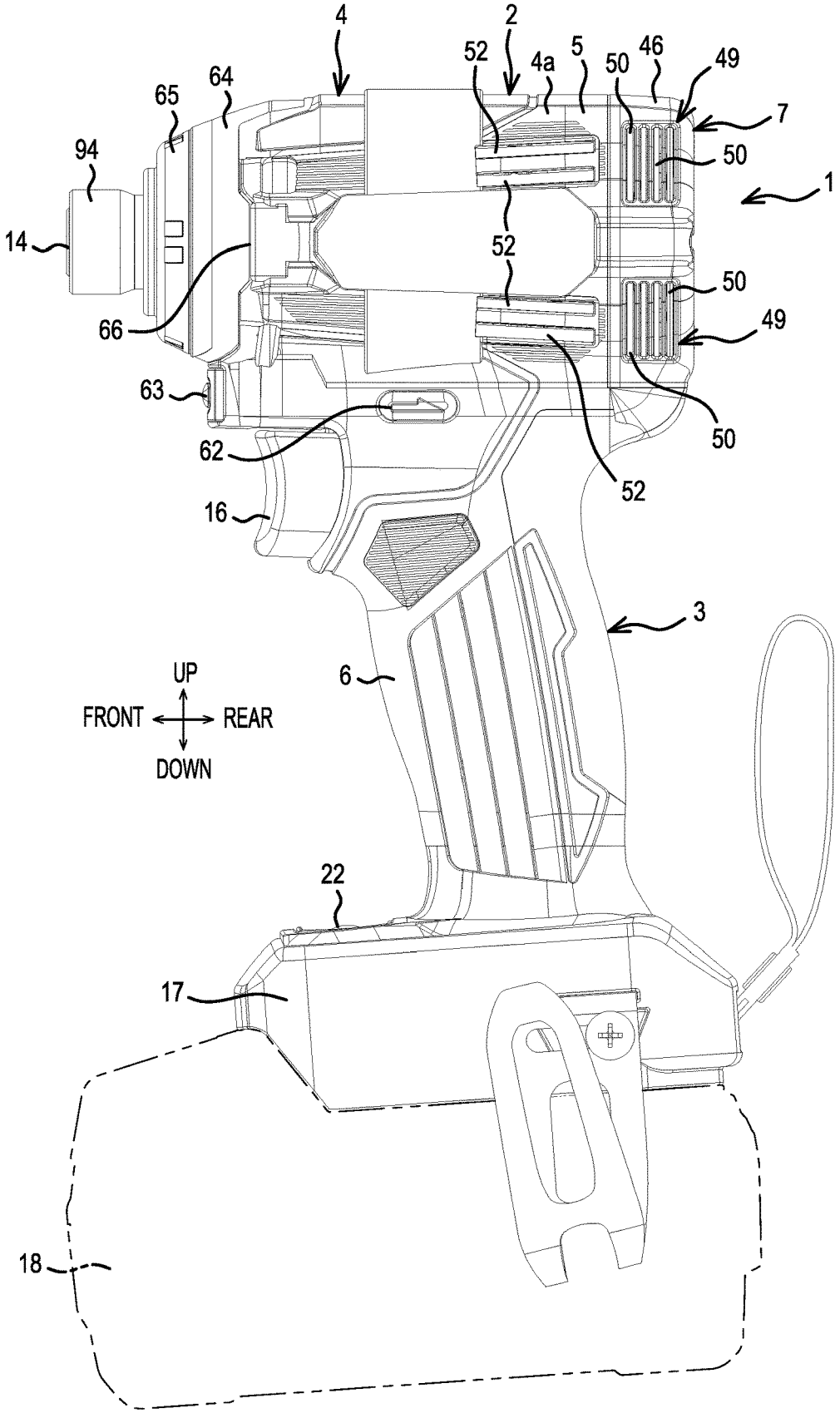
FIG. 1 is a side view of an impact driver according to one representative embodiment of the present teachings.
Figure 2:
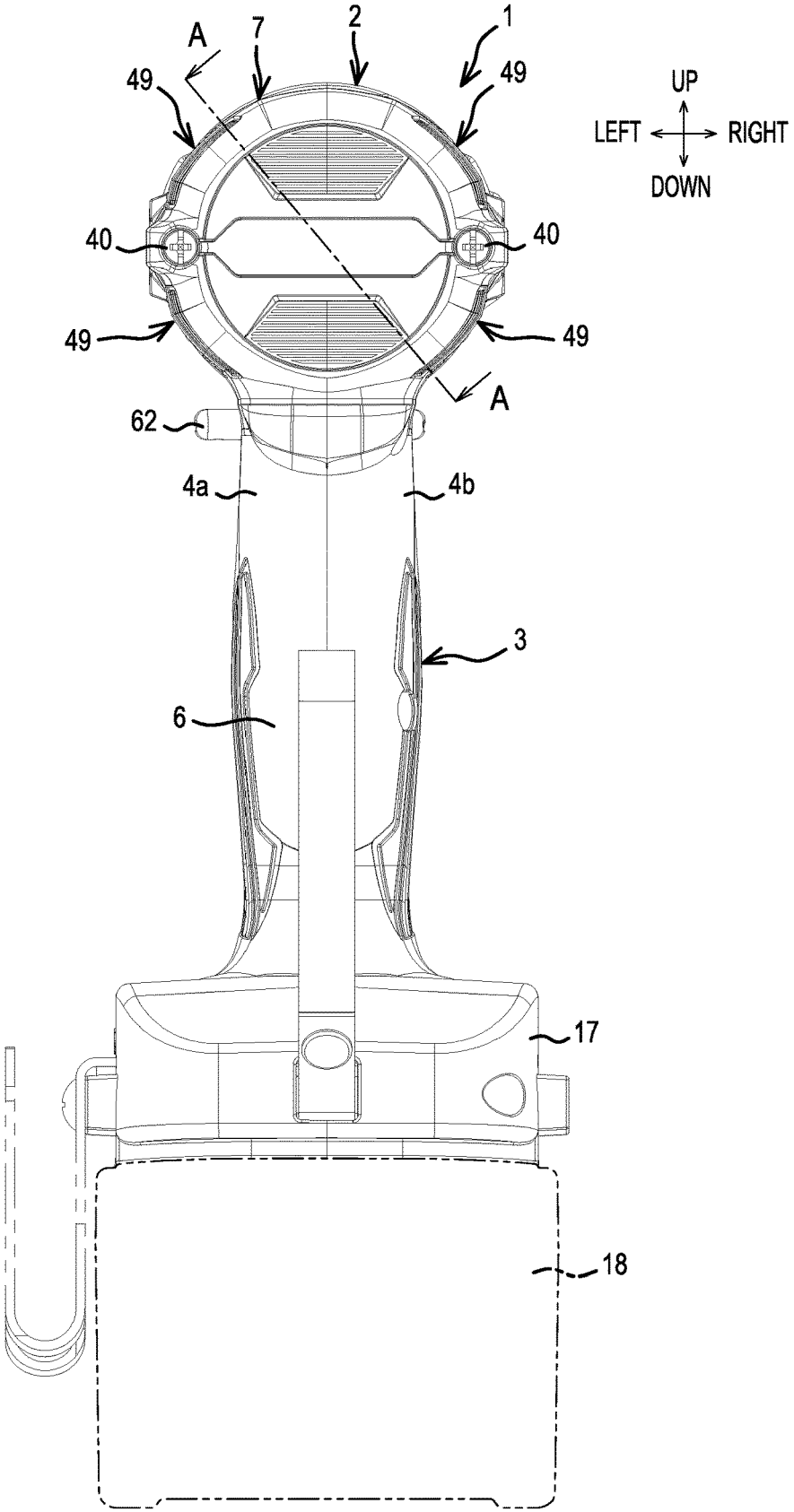
FIG. 2 is a rear view of the impact driver.
Figure 3:
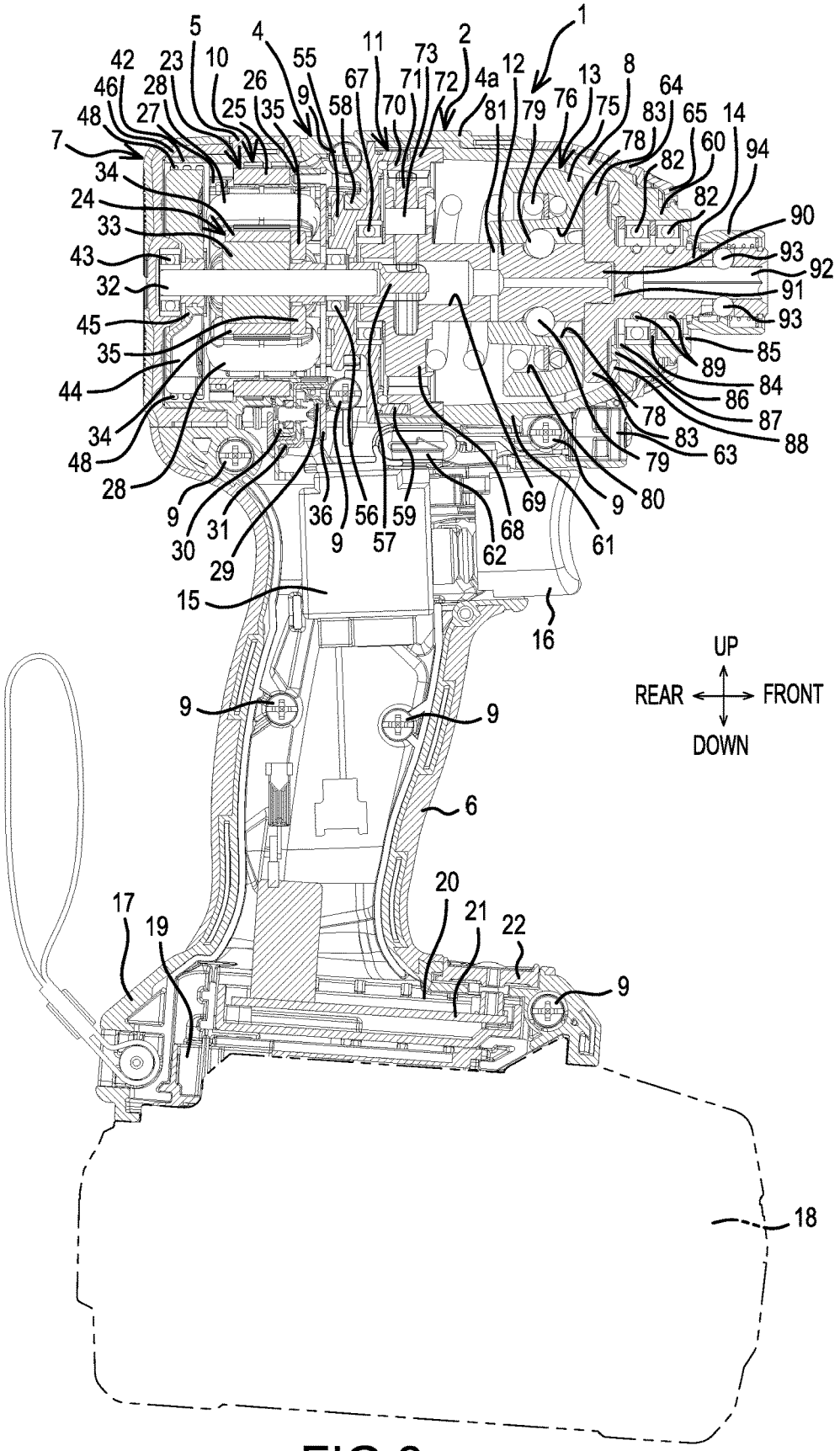
FIG. 3 is a center, longitudinal, cross-sectional view of the impact driver.

FIG. 1 is a side view of a rechargeable impact driver 1, which is one example of a power tool according to the present teachings; FIG. 2 is a rear view; and FIG. 3 is a center, longitudinal, cross-sectional view.

The impact driver 1 comprises: a main-body part 2, whose central axis extends in a front-rear direction; and a grip part 3, which protrudes downward from the main-body part 2. The impact driver 1 has a housing that comprises: a main-body housing 4, which is formed by contiguously coupling a tube-shaped motor housing 5 that forms a portion of the main-body part 2 and a grip housing 6 that forms a portion of the grip part 3; a rear housing 7, which is mounted on a rear end of the motor housing 5 by the fastening of one or more screws; and a hammer case 8, which is joined to a front part of the motor housing 5. The main-body housing 4 is divided into left and right half housings 4*a*, 4*b*, which are joined together by screws 9 from the left side.

A motor 10, a planetary-gear, speed-reducing mechanism 11, a spindle 12, and an impact mechanism 13 are provided, in order from the rear, inside the main-body part 2. The motor 10 is housed in the motor housing 5 and the rear housing 7. The planetary-gear, speed-reducing mechanism 11, the spindle 12, and the impact mechanism 13 are each housed in the hammer case 8. An anvil 14, which is provided on the impact mechanism 13 and constitutes an output part, protrudes forward from a front end of the hammer case 8.

A switch 15, from which a trigger 16 protrudes forward, is housed in an upper part of the grip part 3. A battery-mount part 17, on which a battery pack 18 that constitutes a power supply is mounted, is formed on a lower end of the grip part 3. A terminal block 19, which is electrically connected to the battery pack 18, and a controller 20, which is located thereabove, are housed inside the battery-mount part 17. A control circuit board 21, on which a microcontroller, a switching device, etc. are installed, is provided on the controller 20. A display panel 22, which is electrically connected to the control circuit board 21 and displays the rotational speed of the motor 10, the remaining charged capacity (remaining battery capacity) of the battery pack 18, and the like, is provided on an upper surface of the battery-mount part 17.

Figure 4:
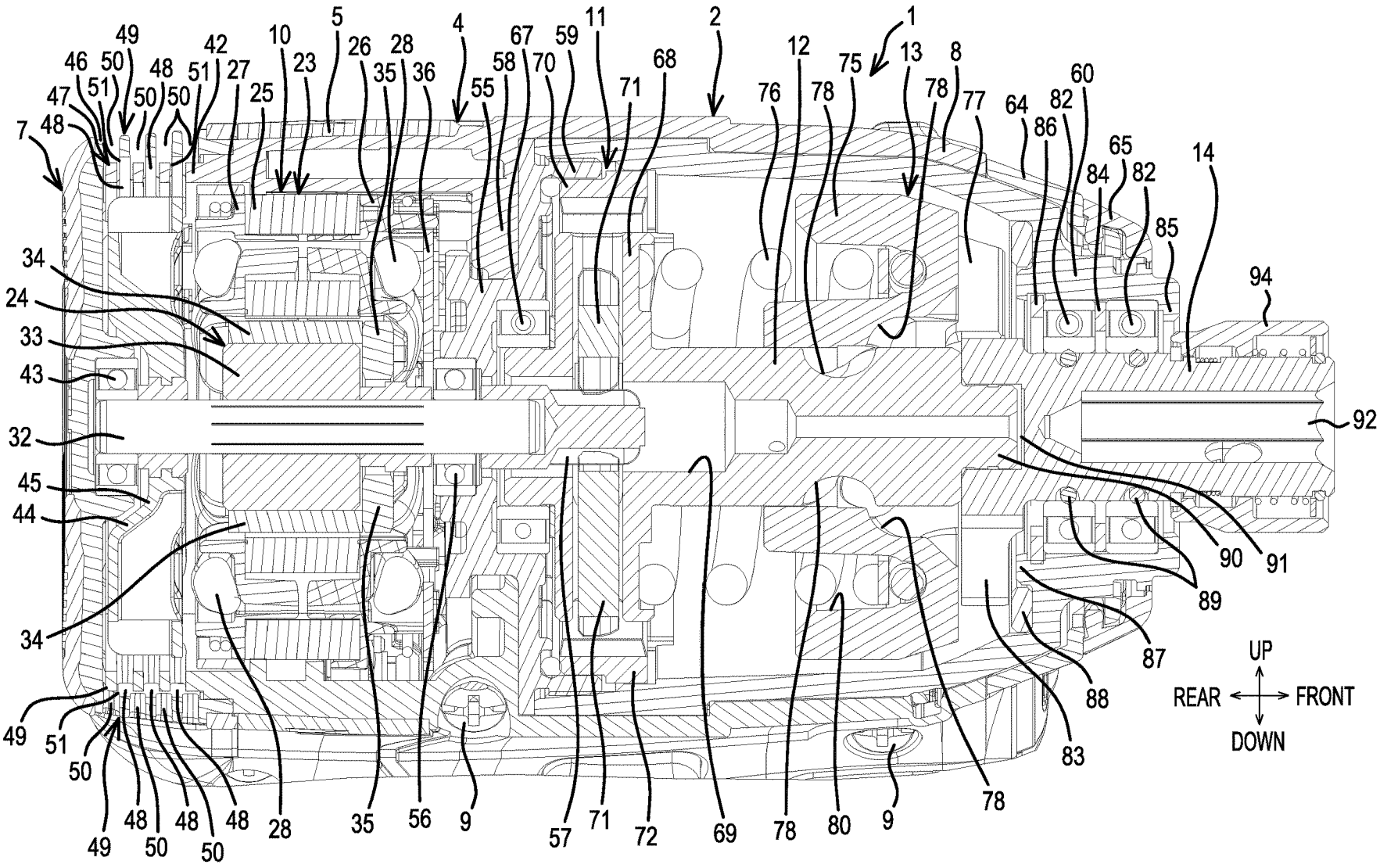
FIG. 4 is an enlarged cross-sectional view taken along line A-A in FIG. 2.

The motor 10 is an inner-rotor type brushless motor that comprises a stator 23 and a rotor 24. As shown also in FIG. 4, the stator 23 comprises: a stator core 25, which is formed by a plurality of layers of steel sheets; a front insulating member 26 and a rear insulating member 27, which are respectively provided frontward and rearward of the stator core 25; and coils 28 that are wound on the stator core 25 and around the front insulating member 26 and the rear insulating member 27. The stator 23 is held inside the motor housing 5. Fusing terminals 29 are provided on the front insulating member 26. One end of each fusing terminal 29 sandwiches and fuses a wire that forms the coils 28. The other end of each fusing terminal 29 is routed to a coupling piece 30, which is provided downward facing such that it protrudes from a lower end of the front insulating member 26. A terminal unit 31 is screw-fastened to the coupling piece 30 from below such that the terminal unit 31 is pinched by the coupling piece 30 and thereby electrically connected thereto. The terminal unit 31 has a U shape in side view, is wired from the controller 20, and has lead wires corresponding to the fusing terminals 29 soldered thereto. A three-phase power-supply line, which is routed from the terminal unit 31, passes rearward of the switch 15 through the interior of the grip part 3 and is connected to the control circuit board 21 inside the controller 20.

The rotor 24 comprises: a rotary shaft 32, which is located at the axial center; a tube-shaped rotor core 33, which is disposed around the rotary shaft 32; permanent magnets 34, which are disposed around an outer side of the rotor core 33 and form a tubular shape altogether, and whose polarities alternate in the circumferential direction; and discoidal (disk shaped) permanent magnets 35 for sensing, which are disposed on a front side thereof. A sensor circuit board 36, which detects the positions of the permanent magnets 35 of the rotor 24 and on which three rotation-detection devices that output rotation-detection signals are mounted, is fixed by a screw to a front end of the front insulating member 26. Signal lines, which output the rotation-detection signals, are connected to a lower end of the sensor circuit board 36, and these signal lines also pass rearward of the switch 15 through the interior of the grip part 3 and are connected to the control circuit board 21 inside the controller 20, the same as the power-supply lines.

Figure 5:
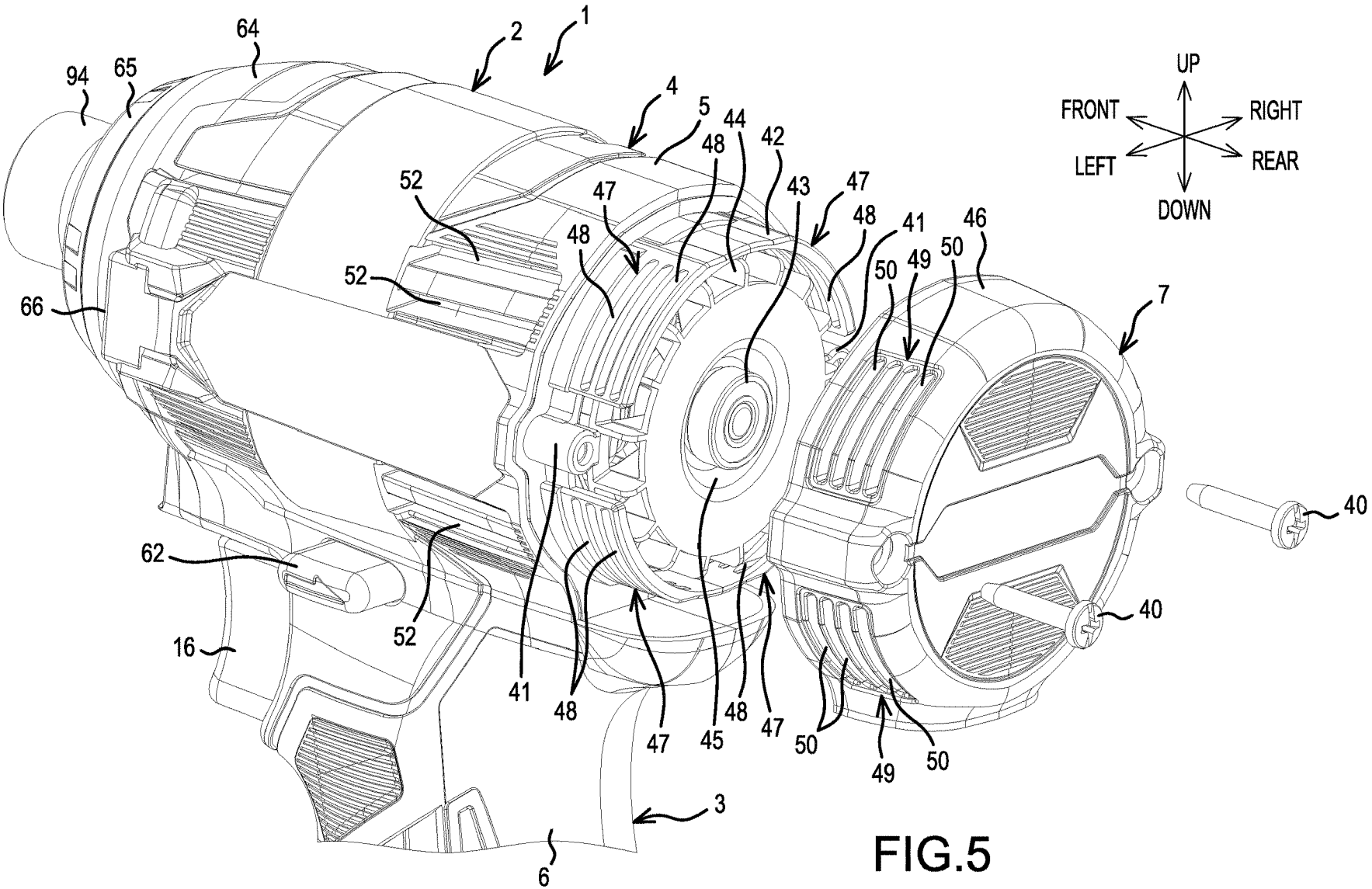
FIG. 5 is an oblique view, viewed from the rear, of a main-body part, which has been separated from a rear housing.
Figure 6A:
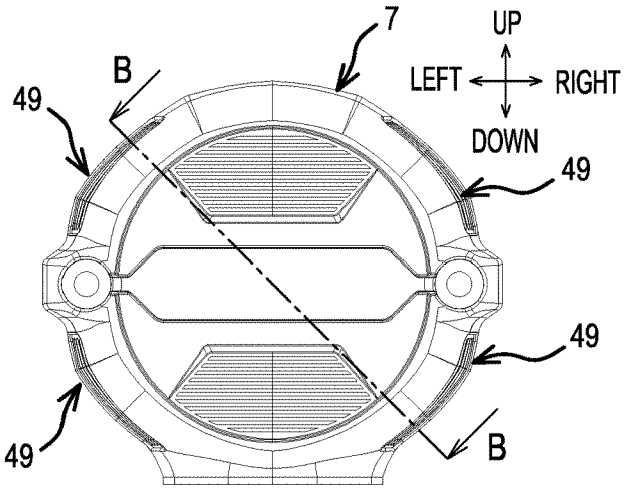
Figure 6B:
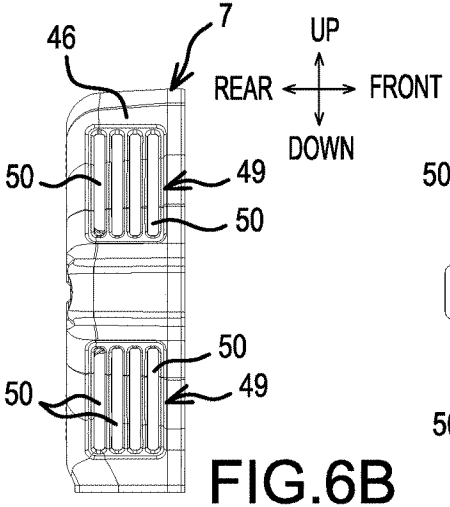
Figure 6C:
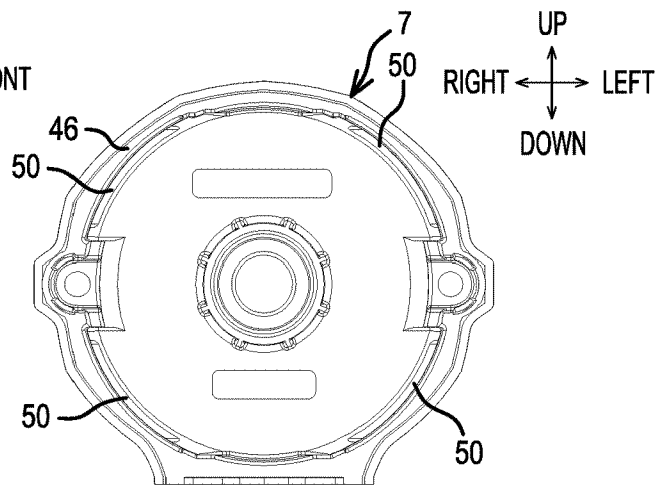
Figure 6D:
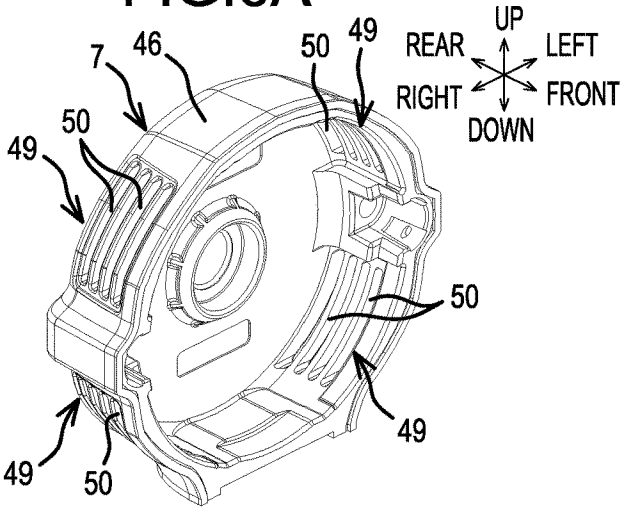
Figure 6E:
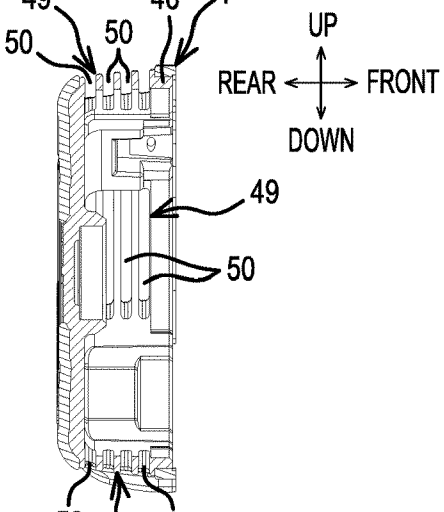

As shown in FIG. 5, the rear housing 7 has a cap shape and is mounted, from the rear, onto the motor housing 5 using left and right screws 40. Screw bosses 41 are provided, rearward facing on the left and right, such that they protrude from a rear surface of the motor housing 5. An inner-side overlapping part 42, which has a ring shape and whose outer diameter is smaller than an outer diameter of the motor housing 5, is provided, rearward facing and coaxial with the motor housing 5, such that it protrudes beyond the inner sides of the screw bosses 41. When the rear housing 7 covers the inner-side overlapping part 42 from the rear, the rear housing 7 is mounted (joined thereto) by screwing the screws 40 into the screw bosses 41.

In addition, a bearing 43 is held by a center part of a rear-side inner surface of the rear housing 7 and axially supports the rear end of the rotary shaft 32. Forward of the bearing 43, a centrifugal fan 44 for cooling the motor is mounted on the rotary shaft 32. A center part of the centrifugal fan 44 forms a flared part 45, which flares forward in a bowl shape. The bearing 43 is disposed such that it overlaps the centrifugal fan 44 in a radial direction on the immediate rear side of the flared part 45.

Furthermore, the rear housing 7 comprises a ring-shaped outer-side overlapping part 46, which is superimposed from the outer side on the inner-side overlapping part 42 when the rear housing 7 is assembled (mounted) onto the motor housing 5. That is, the outer-side overlapping part 46 radially surrounds the inner-side overlapping part 42. The inner-side overlapping part 42 and the outer-side overlapping part 46 are located radially outward of the centrifugal fan 44 and, in the present embodiment, do not contact each other in the radial direction.

The inner-side overlapping part 42 has inner-side exhaust regions 47 formed symmetrically at prescribed spacings, two each on the left and right. Each inner-side exhaust region 47 has three slit-shaped inner-side exhaust ports 48, which extend in (along) the circumferential direction and are provided in parallel at prescribed spacings along the axial direction of the motor housing 5.

In addition, as shown in FIGS. 6A-6E, the outer-side overlapping part 46 has outer-side exhaust regions 49 formed symmetrically at prescribed spacings, two each on the left and right. Each outer-side exhaust region 49 has four slit-shaped outer-side exhaust ports 50, which extend in the circumferential direction and are provided in parallel at prescribed spacings along the axial direction of the motor housing 5.

Figure 7:
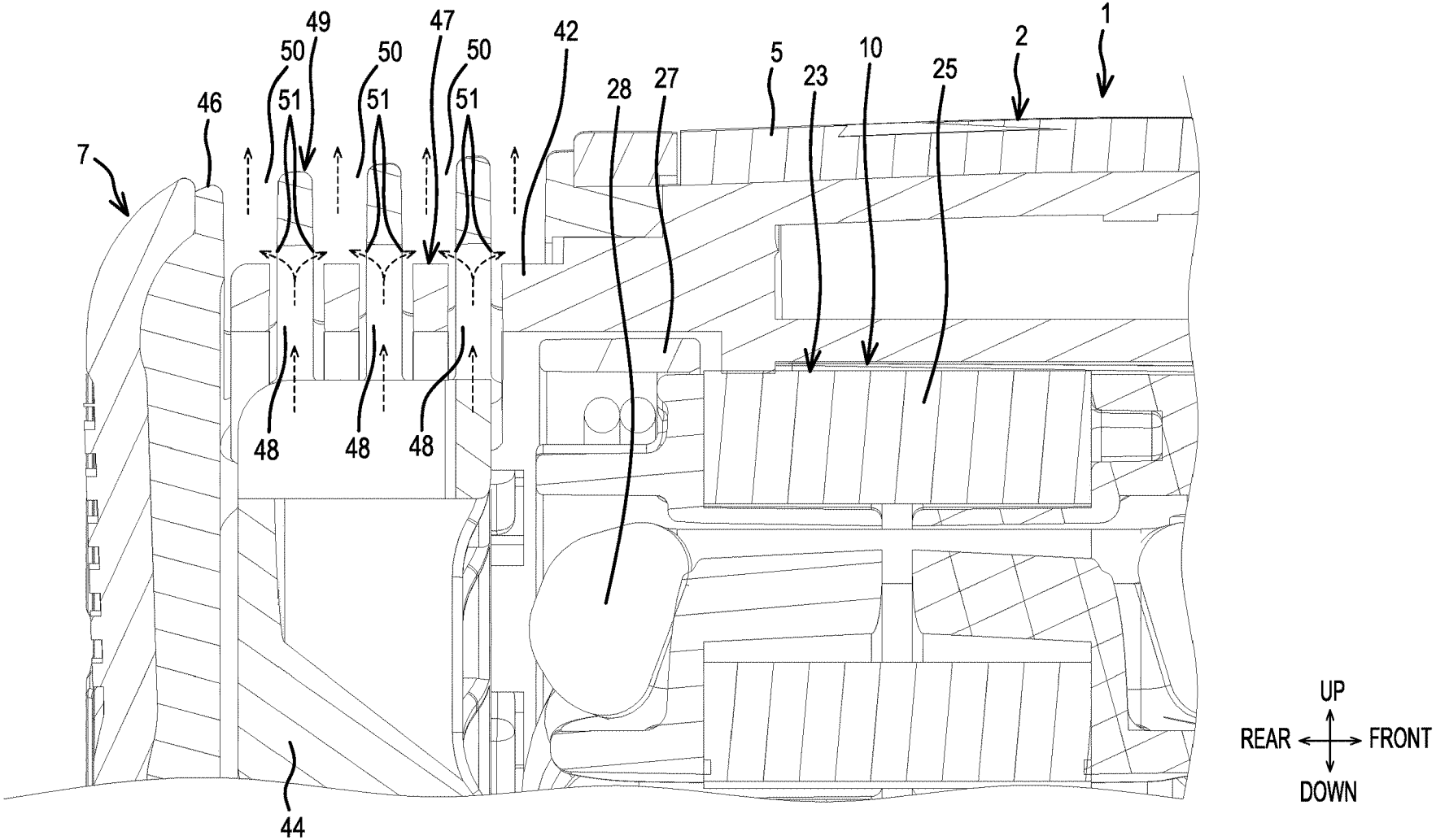
FIG. 7 is an enlarged view of an exhaust-port portion shown in FIG. 4.
Figure 8A:
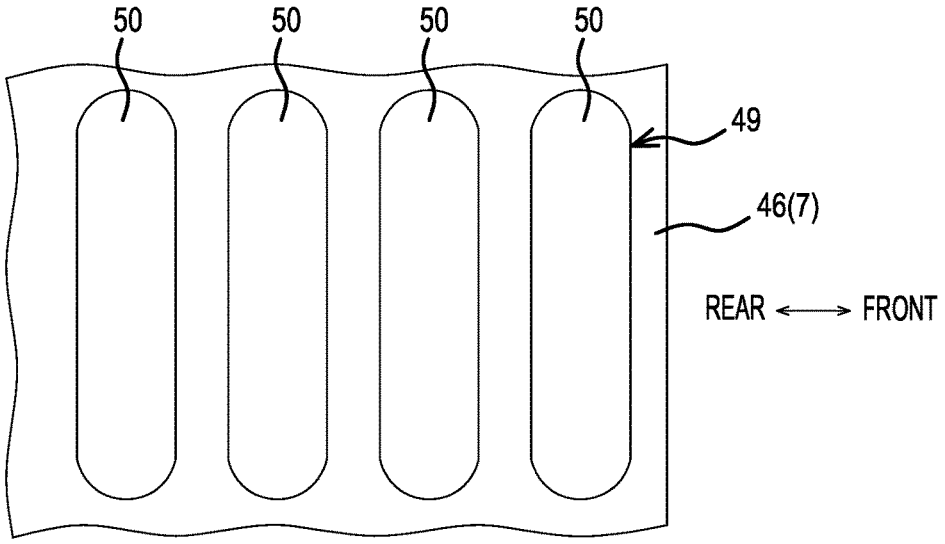
FIGS. 8A-8C are explanatory diagrams that show in FIG. 8A inner-side exhaust ports, in FIG. 8C outer-side exhaust ports, and in FIG. 8C the overlap of offset inner-side exhaust ports and outer-side exhaust ports, which define communication paths therebetween.
Figure 8B:
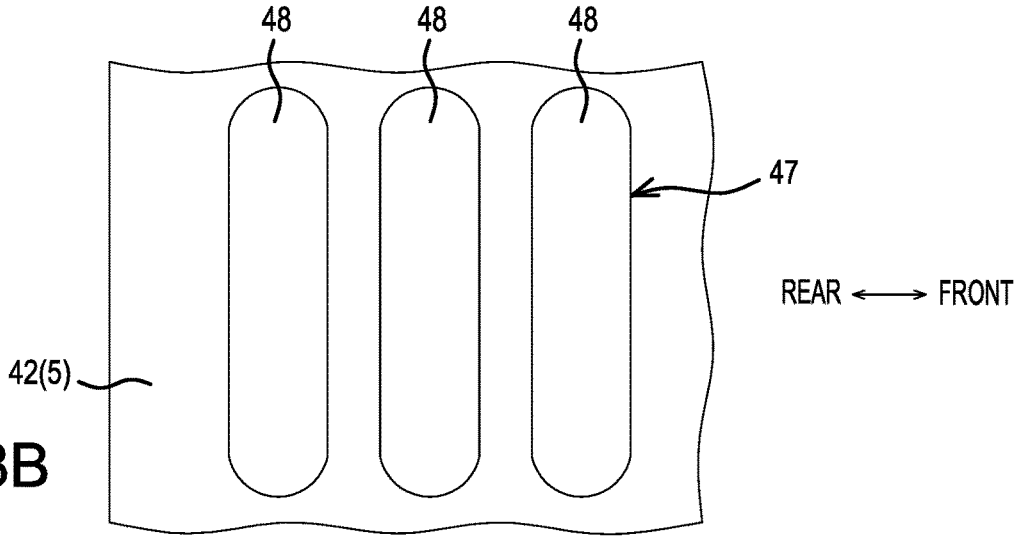
Figure 8C:
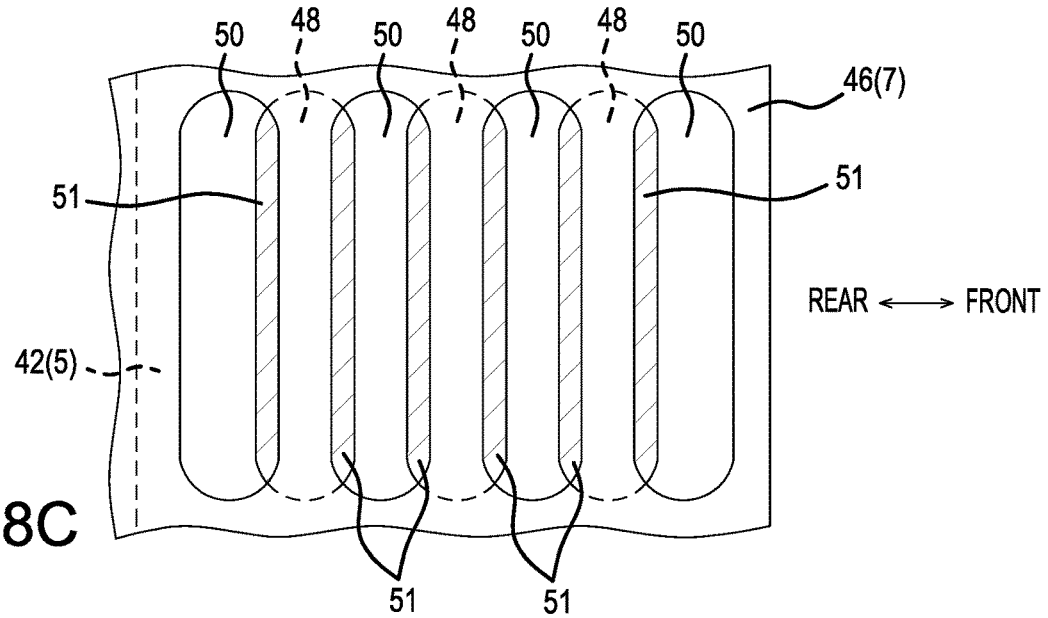

Thus, when the rear housing 7 is mounted on the motor housing 5, the inner-side exhaust regions 47 overlap the outer-side exhaust regions 49 in the radial direction of the centrifugal fan 44. However, as shown in FIG. 7, the outer-side exhaust ports 50 are shifted (offset) in the axial direction relative to the inner-side exhaust ports 48. That is, each inner-side exhaust port 48 is located between two of the outer-side exhaust ports 50, 50. But, as viewed from the outer side in the radial direction, the lengthwise-edges of the outer-side exhaust ports 50 partially overlap the lengthwise-edges of the inner-side exhaust ports 48 in the axial direction, as can be seen in FIG. 8C. Consequently, between the inner-side overlapping part 42 and the outer-side overlapping part 46, communication paths 51 are formed (defined) that open outward in the radial direction along small regions created by the overlap (projection) of the outer-side exhaust ports 50 and the inner-side exhaust ports 48 in the radial direction. The communication paths 51 provide gaps between an outer-circumferential surface of the inner-side overlapping part 42 and an inner-circumferential surface of the outer-side overlapping part 46 that permit the inner-side exhaust ports 48 to fluidly communicate with the outer-side exhaust ports 50. The width of each inner-side exhaust port 48 and each outer-side exhaust port 50 in the axial direction is approximately 1.2-1.5 mm, but the width of the opening of each communication path 51 in the axial direction is preferably substantially less than 1.0 mm, e.g., less than 0.8 mm, more preferably less than 0.5 mm. Therefore, a pin having a diameter of 1.0 mm cannot ingress (cannot pass through the communication paths 51 into the interior of the motor housing 5). That is, IP4X defined by the IEC Standard is satisfied by this design.

To permit air to be drawn into the motor housing 5, air-suction ports 52 (see FIGS. 1 and 5) are formed in side surfaces of the motor housing 5 forward of the rear housing 7.

In the interior of the motor housing 5, a front end of the rotary shaft 32 is passed through a bearing retainer 55, which is forward of the motor 10 and held by the motor housing 5, protrudes forward, and is axially and radially supported by a bearing 56, which is held by a rear part of the bearing retainer 55. A pinion 57 is mounted on a front end of the rotary shaft 32.

The bearing retainer 55 is made of metal, has a disk shape, the center of which is formed into a neck (ring-shaped groove) part. Therefore, by mating (fitting, engaging) a rib 58, which is provided on an inner surface of the motor housing 5, in the neck part, the bearing retainer 55 is held by the motor housing 5 such that movement of the bearing retainer 55 is restricted (blocked) in the front-rear direction.

In addition, a ring wall 59, which has a male thread formed on the outer circumference thereof, is provided on a peripheral edge of the front surface of the bearing retainer 55 such that it projects forward. A female thread is provided on a rear-end inner circumference of the hammer case 8 and is coupled to the male thread on the ring wall 59.

The hammer case 8 is a tubular body—which is made of metal, and in which a front-half portion is tapered and a front-tube part 60 is formed on a front end—and a rear part of the hammer case 8 is closed up by the bearing retainer 55, which constitutes a cover. A pair of left and right lower-side projections 61, which have a wall shape and extend in the front-rear direction, is formed on a lower surface of the hammer case 8. In the assembled state, presser ribs (not shown), which protrude from the inner surfaces of the left and right half housings 4*a*, 4*b*, make contact with side surfaces of the lower-side projections 61. Owing to the engagement of the lower-side projections 61 with the presser ribs, rotation of the hammer case 8 is restricted (blocked).

A forward/reverse-switching lever (reversing switch lever) 62 for changing the rotational direction of the motor 10 is provided on the main-body housing 4 between the hammer case 8 and the switch 15 such that the forward/reverse-switching lever 62 can slide in the left-right direction. Forward thereof, a switch 63, which is provided for changing the impact modes, is held on the main-body housing 4 in a forward-facing attitude such that a button part is exposed on the front surface. By repeatedly pressing the button part, the impact force is switchable among four stages (different impact force levels) and a stored impact mode.

In addition, a hammer-case cover 64 is made of a polymer material (resin), is translucent, and covers the front-tube part 60 of the hammer case 8 from the front part of the hammer case 8. The hammer-case cover 64 is provided on the forward side of the motor housing 5. A bumper 65, which is formed of an elastic body (elastomeric material), is mounted on a front-end, outer-circumference part of the hammer-case cover 64. Rearward of the bumper 65, lights 66, e.g., LEDs, are provided forward facing on the left and right of the hammer-case cover 64.

Furthermore, a bearing 67 is held by the front part of the bearing retainer 55, and a rear end of the spindle 12 is axially and radially supported by the bearing 67. The spindle 12 comprises a disk-shaped carrier part 68, the rear part of which is hollow. The front end of the rotary shaft 32 and the pinion 57 protrude into the interior of a through hole 69, which is formed from a rear surface along the axial center.

The planetary-gear, speed-reducing mechanism 11 comprises an internal gear 70, which has internal teeth, and three planet gears 71, which have external teeth that mesh with the internal gear 70. The internal gear 70 is housed coaxially on the inner side of the ring wall 59 of the bearing retainer 55. On the outer-circumference side of a front part thereof, a rotation-stop part 72, which engages with the inner-circumferential surface of the hammer case 8, is provided. The planet gears 71 are rotatably supported inside the carrier part 68 by respective pins 73 and mesh with the pinion 57 of the rotary shaft 32.

The impact mechanism 13 comprises a hammer 75, which is mounted around the spindle 12, and a coil spring 76, which biases the hammer 75 forward. The hammer 75 comprises a pair of tabs 77 on its front surface and is joined with the spindle 12 via balls 79 that span and are mated with cam grooves 78, which are formed on an inner surface of the hammer 75 and an outer surface of the spindle 12. In addition, a ring-shaped groove 80 is formed on a rear surface of the hammer 75, and a front end of the coil spring 76 is inserted therein. A rear end of the coil spring 76 makes contact with a front surface of the carrier part 68. A communication hole 81, which fluidly communicates orthogonally with the through hole 69, is formed in the spindle 12. The communication hole 81 is configured to supply grease that is inside the through hole 69 to the space between the hammer 75 and the spindle 12.

The anvil 14 is axially supported by two (front and rear) ball bearings 82, which are held inside the front-tube part 60 of the hammer case 8. A pair of arms 83 is configured to respectively engage with the pair of tabs 77 of the hammer 75 in the rotational direction. The arms 83 are formed on a rear end of the anvil 14.

An intermediate washer 84 is interposed between the two ball bearings 82. Because the intermediate washer 84 contacts the respective outer rings of the ball bearings 82, a prescribed spacing is maintained between the front and rear ball bearings 82.

The outer diameters of the ball bearings 82 and the intermediate washers 84 herein are the same. A ring-shaped positioning part 85 is provided circumferentially around the front end of the front-tube part 60. Because the outer ring of the front-side ball bearing 82 contacts the positioning part 85, the forward positioning of the positioning part 85 is achieved. In addition, a rear washer 86, which is for rearward positioning of the ball bearings 82, is provided rearward of the rear-side ball bearing 82. The rear washer 86 has an outer diameter larger than that of the ball bearings 82, mates with the inner-circumferential surface of the front-tube part 60, and contacts the outer ring of the rear-side ball bearing 82.

In addition, a ring-shaped retaining part 87, whose inner diameter is smaller than the outer diameter of the rear washer 86 and whose outer diameter is larger than the outer diameter of the rear washer 86, is coaxially provided forward of the arms 83 such that it protrudes from an inner-circumference side of a rear surface of the front-tube part 60. An outer washer 88, which is made of a polymer material (resin), which is thick, and whose rear surface is located rearward of the retaining part 87, mates with an outer side of the retaining part 87. The outer washer 88 receives the arms 83.

Furthermore, two O-rings 89 are respectively provided on the inner sides of the two ball bearings 82, one on the front and one on the rear, of the anvil 14 and respectively contact the inner rings of the ball bearings 82.

A mating recessed part 91, in which a mating projection 90 provided on a front end of the spindle 12 at the axial center mates, is formed on a rear surface of the anvil 14 at the axial center. The through hole 69 of the spindle 12 fluidly communicates with the mating recessed part 91 and provides lubrication between the spindle 12 and the anvil 14 by supplying grease to the mating recessed part 91.

On the other side of the anvil 14, an insertion hole 92, which has a hexagonal shape in transverse section and into which a bit is insertable from the front, is formed in the axial center of the anvil 14 such that it is open from a front end thereof.

In addition, balls 93, which are capable of protruding from and immersing into the insertion hole 92, are housed inside the anvil 14 and are retainable by virtue of engaging with the bit (tool accessory) at the protruding position. The protruding position is maintained by a manipulatable sleeve 94, which is mounted around the tip of the anvil 14. Thus, when the manipulatable sleeve 94 is manually slid forward, the pressing of the balls 93 is released, and thereby it becomes possible to pull the bit (tool accessory) out.

In the impact driver 1 configured as described above, when the trigger 16 is pulled and the switch 15 is turned ON after the bit (not shown) has been mounted in the anvil 14, electric power is supplied to the motor 10, and the rotary shaft 32 rotates. That is, the microcontroller of the control circuit board 21 obtains the rotational state of the rotor 24 by acquiring the rotation-detection signals, which were output from the rotation-detection devices of the sensor circuit board 36 and indicate the positions of the permanent magnets 35 of the rotor 24, controls the ON/OFF state of each switching device in accordance with the obtained rotational state, supplies electric current, in order, to each of the coils 28 of the stator 23, and thereby rotates the rotor 24.

When the rotary shaft 32 rotates together with the rotor 24, the planet gears 71, which mesh with the pinion 57, revolve inside the internal gear 70 and rotate the spindle 12 at a reduced speed via the carrier part 68. Thereby, the hammer 75 also rotates, the anvil 14 is rotated via the arms 83, which engage the tabs 77, and it becomes possible to perform a screw fastening operation using the bit B. At this time, the anvil 14 is axially supported by the two ball bearings 82 on the front and the rear, and therefore rattling of the anvil 14 with respect to the hammer case is inhibited and vibration of the bit at the tip is reduced.

As the screw tightening progresses and the torque applied to the anvil 14 increases, the hammer 75 retracts (moves rearward) against the biasing of the coil spring 76 while the balls 7 roll along the cam grooves 78 of the spindle 12. Then, when the tabs 77 respectively separate from the arms 83, the hammer 75 rotates while advancing owing to the biasing of the coil spring 76 and the guiding of the cam grooves 78, the tabs 77 once again engage with the arms 83, and a rotational impact force is generated by the hammer 75 via anvil 14. It is possible to perform further screw fastening operations by repeating this process.

Furthermore, when the centrifugal fan 44 rotates together with the rotation of the rotary shaft 32, outside air is sucked in via the air-suction ports 52, passes through the interior of the motor housing 5, cools the motor 10, then is directed outward in the radial direction of the centrifugal fan 44. Therefore, as shown by dotted-line arrows in FIG. 7, the exhaust air passes through the inner-side exhaust ports 48, the communication paths 51, and the outer-side exhaust ports 50 and is thereby exhausted to the exterior of the impact driver 1. In this embodiment, because the opening area (or the width in the axial (front-rear) direction of the rotor) of each of the communication paths 51 is smaller than the opening areas (or the widths in the axial (front-rear) direction of the rotor) of the inner-side exhaust ports 48 and the outer-side exhaust ports 50, foreign matter, such as dust, is inhibited (blocked) from entering from the exterior, while still ensuring that the exhaust air can be exhausted from the interior of the motor housing 5 without undue impedance.

Thus, it is noted that, in one aspect of the present teachings, the impact driver 1 of the above-described embodiment comprises, e.g., the motor 10 comprising the stator 23, the rotor 24, which is rotatable relative to the stator 23, and the centrifugal fan 44 (fan), which is rotatable integrally with the rotor 24; and the motor housing 5 (first housing) and the rear housing 7 (second housing), which (i)

are each made of a polymer material (resin), (ii) together house the motor 10 and (iii) respectively have the inner-side overlapping part 42 and the outer-side overlapping part 46 (mutually overlapping portions) located on an outer-circumference side of the centrifugal fan 44. Furthermore, the inner-side exhaust ports 48 (first exhaust ports) and the outer-side exhaust ports 50 (second exhaust ports), which exhaust air directed from the centrifugal fan 44, are respectively formed, in the inner-side overlapping part 42 of the motor housing 5 and in the outer-side overlapping part 46 of the rear housing 7, such that they are offset from one another, preferably in the axial direction of the rotor 24. The communication paths 51 are formed (provided) between the inner-side exhaust ports 48 on the motor housing 5 side and the outer-side exhaust ports 50 on the rear housing 7 side. Each of the communication paths 51 has an opening area (or width in the axial direction) that is smaller than the opening area (or width in the axial direction) of each of the exhaust ports 48, 50. Therefore, foreign matter can be effectively blocked (inhibited) from entering into the motor housing 5 via the air exhaust ports 48, 50.

In the present embodiment, the inner-side overlapping part 42 and the outer-side overlapping part 46 do not contact each other in the radial direction of the centrifugal fan 44. Furthermore, the communication paths 51 are formed (defined) between the inner-side overlapping part 42 and the outer-side overlapping part 46. Therefore, all of the outer-side exhaust ports 50 can be offset in the radial direction of the centrifugal fan 44 from all of the inner-side exhaust ports 48, thereby blocking (or narrowing) the entire opening area (or width in the axial direction) of the inner-side exhaust ports 48 that is exposed to the exterior, thereby, effectively blocking (inhibiting) the ingress of foreign matter.

In addition, the inner-side exhaust ports 48 and the outer-side exhaust ports 50 are formed as slit shapes that extend along the circumferential direction of the centrifugal fan 44. Furthermore, the inner-side exhaust ports 48 and the outer-side exhaust ports 50 are formed such that they are offset from one another in the axial direction of the rotor 24. Therefore, the communication paths 51 can be formed between the inner-side exhaust ports 48 and the outer-side exhaust ports 50 in a simple manner.

It is noted that the number, shape, and the like of the inner-side exhaust ports and the outer-side exhaust ports are not limited to those in the above-mentioned embodiment and can be appropriately changed, as long as the inner-side exhaust ports and the outer-side exhaust ports can be disposed such that they are offset from one another; for example, the number of the exhaust ports can be increased or decreased in the axial direction, the circumferential direction, or the like, the openings can be made circular, square, or the like instead of slit shaped, and the like.

In addition, in the above-described embodiment, although the inner-side overlapping part and the outer-side overlapping part are configured to be non-contacting and the communication paths are formed by the partial overlapping of the inner-side exhaust ports and the outer-side exhaust ports, the inner-side overlapping part and the outer-side overlapping part may be superimposed in a contacting state. In this alternate embodiment, even if there is no gap between the inner-side overlapping part and the outer-side overlapping part, as shown in FIG. 8A, B, the outer-side exhaust ports 50 and the inner-side exhaust ports 48 may be formed, in the outer-side overlapping part 46 and the inner-side overlapping part 42, offset such that they partially overlap in the radial direction. Therefore, in the assembled state, as shown by hatching in FIG. 8C, the communication paths 51 are formed with opening area (or width) that is smaller than the opening area (or width) of the exhaust ports 48, 50, thereby effectively blocking (inhibiting) the ingress of foreign matter. However, even if the exhaust ports do not partially overlap one another in this manner, the communication paths can be obtained as long as at least one of the outer surface of the inner-side overlapping part and the inner surface of the outer-side overlapping part has a groove formed therein.

Furthermore, even in the alternate embodiment in which all of the inner-side exhaust ports and the outer-side exhaust ports are offset without partially overlapping, the inner-side overlapping part and the outer-side overlapping part do not contact each other, and therefore the communication paths can be formed simply by the gap between the inner-side overlapping part and the outer-side overlapping part.

On the other hand, in the above-described embodiment, the inner-side overlapping part is formed on the motor housing, and the outer-side overlapping part is formed on the rear housing; however, conversely, they may be mutually superimposed by forming the outer-side overlapping part on the motor housing and forming the inner-side overlapping part on the rear housing.

Furthermore, although an explanation based on an impact driver in the above-mentioned embodiment is provided, the present invention is not limited to an impact driver, and the structure of the exhaust ports in the above-described embodiment can be used on the outer-circumference side of a fan even in power tools such as driver-drills, reciprocating saws, hammer drills, and the like. In addition, the present invention is not limited to a rechargeable type and can be used also in an AC tool in which a battery pack does not serve as the power supply.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools, such as but not limited to impact drivers.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Impact driver
2 Main-body part

3 Grip part
4 Main-body housing
5 Motor housing
6 Grip housing
7 Rear housing
8 Hammer case
10 Motor
11 Planetary-gear, speed-reducing mechanism
12 Spindle
13 Impact mechanism
14 Anvil
23 Stator
24 Rotor
32 Rotary shaft
42 Inner-side overlapping part
44 Centrifugal fan
46 Outer-side overlapping part
47 Inner-side exhaust region
48 Inner-side exhaust port
49 Outer-side exhaust region
50 Outer-side exhaust port
51 Communication path
52 Air-suction port
75 Hammer
76 Coil spring

I claim:

1. A power tool comprising:

a motor comprising a stator, a rotor that is rotatable relative to the stator around a rotational axis, and a fan that rotates integrally with the rotor;

a tubular motor housing made of a polymer material and extending in a direction parallel to the rotational axis of the rotor, the motor housing having a rear end and a first opening at the rear end, a first portion of the motor housing at the rear end of the motor housing including a plurality of first air exhaust ports;

a rear housing made of a polymer material, the rear housing including a base wall and a flange projecting from a periphery of the base wall, the flange including a plurality of second air exhaust ports; and a grip housing extending integrally from the motor housing in a direction perpendicular to the rotational axis of the rotor, wherein:

the rear housing is mounted at the rear end of the motor housing such that the flange radially surrounds the first portion of the motor housing, and the rear housing is connected to the motor housing by at least one screw, the first portion and the flange radially surround an outer circumference of the fan; and the first air exhaust ports are offset from the second air exhaust ports.

2. The power tool according to claim 1, wherein the first air exhaust ports are offset from the second air exhaust ports in the direction parallel to the rotational axis of the rotor.

3. The power tool according to claim 2, wherein:

fluid communication paths are defined between the first air exhaust ports and the second air exhaust ports;

the first air exhaust ports and the second air exhaust ports each have a first width in an axial direction; and the fluid communication paths each have a second width in the axial direction that is less than the first width in the axial direction.

4. The power tool according to claim 3, wherein:

the flange is radially spaced from the first portion; and the fluid communication paths are defined by the flange and the first portion.

5. The power tool according to claim 4, wherein each of the first air exhaust ports and the second air exhaust ports is slit shaped and extends around a circumferential direction of the fan.

6. The power tool according to claim 5, wherein the first air exhaust ports partially overlap the second air exhaust ports in the direction parallel to the rotational axis of the rotor.

7. The power tool according to claim 1, further comprising a trigger switch movably mounted on the grip housing and being configured to manually control energization of the motor.

8. The power tool according to claim 1, wherein:

fluid communication paths are defined between the first air exhaust ports and the second air exhaust ports;

the first air exhaust ports and the second air exhaust ports each have a first width in an axial direction; and the fluid communication paths each have a second width in the axial direction that is less than the first width in the axial direction.

9. The power tool according to claim 1, wherein:

the flange and the first portion do not contact each other in the radial direction of the fan; and the communication paths are defined between the flange and the first portion.

10. The power tool according to claim 1, wherein the first air exhaust ports partially overlap the second air exhaust ports in the direction parallel to the rotational axis of the rotor.

11. The power tool according to claim 1, wherein:

the plurality of first air exhaust ports includes a first air exhaust port and a second air exhaust port spaced from the first air exhaust port in the direction parallel to the rotational axis of the rotor; and the plurality of second air exhaust ports includes a third air exhaust port and a fourth air exhaust port spaced from the third air exhaust port in the direction parallel to the rotational axis of the rotor.

12. The power tool according to claim 1, wherein the plurality of first air exhaust ports each have a closed periphery and the plurality of second air exhaust ports each have a closed periphery.

13. A power tool comprising:

a tubular motor housing made of polymer material and extending in a front-rear direction;

a brushless motor at least partially located in the motor housing, the brushless motor comprising a stator that has coils, a rotor that is rotatable relative to the stator and has permanent magnets and extends in the front-rear direction, and a fan disposed rearward of the rotor;

a grip housing extending integrally downward from the motor housing;

a rear housing made of polymer material that closes up a rear portion of the motor housing and is fixed on the motor housing by at least one screw that extends in the front-rear direction;

wherein:

the rear housing covers an open end of the tubular motor housing, first air exhaust ports are formed in the motor housing radially outward of the fan, second air exhaust ports are formed in the rear housing radially outward of the fan;

the first air exhaust ports are located radially inward of the second air exhaust ports, and first parts of the first air exhaust ports overlap the second air exhaust ports in the front-rear direction and second parts of the first air exhaust ports are offset from the second air exhaust ports in the front-rear direction.

14. The power tool according to claim 13, wherein:

the first air exhaust ports include a first set of air exhaust ports and a second set of air exhaust ports circumferentially offset from the first set of air exhaust ports, and the at least one screw is located circumferentially between the first set of air exhaust ports and the second set of air exhaust ports.

15. The power tool according to claim 13, wherein:

the second air exhaust ports include a third set of air exhaust ports and a fourth set of air exhaust ports circumferentially offset from the third set of air exhaust ports, and the at least one screw is located circumferentially between the third set of air exhaust ports and the fourth set of air exhaust ports.

16. The power tool according to claim 13, wherein the rear housing holds a bearing which is arranged between the first air exhaust ports and the second air exhaust ports.

* * * * *